US012365018B2

(12) United States Patent
Jansen et al.

(10) Patent No.: US 12,365,018 B2
(45) Date of Patent: Jul. 22, 2025

(54) CLAMPING SYSTEM FOR A PRESS BRAKE HAVING AN INTEGRALLY FORMED CAVITY OR CHAMBER AND PRESS BRAKE COMPRISING SUCH A CLAMPING SYSTEM

(71) Applicant: WILA B.V., Lochem (NL)

(72) Inventors: Thomas Jan Herbert Jansen, Markelo (NL); Dennis Hermanus Johannes Rouhof, Harbrinkhoek (NL)

(73) Assignee: WILA B.V., Lochem (NL)

( * ) Notice: Subject to any disclaimer, the term of this patent is extended or adjusted under 35 U.S.C. 154(b) by 181 days.

(21) Appl. No.: 18/017,560

(22) PCT Filed: Jul. 16, 2021

(86) PCT No.: PCT/NL2021/050449
§ 371 (c)(1),
(2) Date: Jan. 23, 2023

(87) PCT Pub. No.: WO2022/019754
PCT Pub. Date: Jan. 27, 2022

(65) Prior Publication Data

US 2023/0302516 A1 Sep. 28, 2023

(30) Foreign Application Priority Data

Jul. 24, 2020 (NL) ..... 2026130

(51) Int. Cl.
*B21D 5/02* (2006.01)

(52) U.S. Cl.
CPC ..... *B21D 5/0245* (2013.01)

(58) Field of Classification Search
CPC .... B21B 5/0245; B21B 5/0236; B21B 5/0209
See application file for complete search history.

(56) References Cited

U.S. PATENT DOCUMENTS 6,516,649 B1 2/2003 Mika
2006/0174679 A1 8/2006 Pabich
(Continued)

FOREIGN PATENT DOCUMENTS

EP 3501681 A1 * 6/2019 ..... B21D 5/0245
GB 2057047 A * 3/1981 ..... B21D 5/0209
(Continued)

OTHER PUBLICATIONS

Machine Translation of EP 3501681A1 (Year: 2019).*
(Continued)

*Primary Examiner* — Debra M Sullivan
(74) *Attorney, Agent, or Firm* — KDW Firm PLLC

(57) ABSTRACT

A clamping system for a press brake includes an elongate beam having a receiving space for receiving a part of a bending tool, and a clamping element movable between a first position in which it may engage on the bending tool for clamping it in the receiving space, and a second position for releasing the bending tool. The clamping system includes a pressure chamber fillable with a fluid, and an actuating member for driving the engaging element in accordance with a pressure of the fluid in the pressure chamber. The pressure chamber or a cavity housing the pressure chamber is integrally formed in the elongate beam. A press brake comprising such a clamping system.

16 Claims, 17 Drawing Sheets

(56) References Cited

U.S. PATENT DOCUMENTS

| | | | |
|---|---|---|---|
| 2006/0191313 | A1 | 8/2006 | Harrington |
| 2018/0133774 | A1 | 5/2018 | Hilton |

FOREIGN PATENT DOCUMENTS

| | | | |
|---|---|---|---|
| GB | 2057047 | B | 4/1983 |
| WO | 2010056110 | A1 | 5/2010 |
| WO | 2020225761 | A1 | 11/2020 |

OTHER PUBLICATIONS

International Search Report and Written Opinion for the International Patent Application No. PCT/NL2021/050449, mailed Oct. 7, 2021, 10 pages.

* cited by examiner

CLAMPING SYSTEM FOR A PRESS BRAKE HAVING AN INTEGRALLY FORMED CAVITY OR CHAMBER AND PRESS BRAKE COMPRISING SUCH A CLAMPING SYSTEM

CROSS-REFERENCE TO RELATED APPLICATIONS

This application is a national stage filing under 35 U.S.C. 371 of pending International Application No. PCT/NL2021/050449, filed Jul. 16, 2021, which claims priority to Netherlands Patent Application No. 2026130, filed Jul. 24, 2020, the entirety of which applications are incorporated by reference herein.

TECHNICAL FIELD

The invention relates to a clamping system for a press brake, the clamping system comprising an elongate beam comprising a receiving space for receiving a part of a bending tool, a clamping element, the clamping element being movable between a first position, in which it may engage on the bending tool for clamping it in the receiving space, and a second position for releasing the bending tool, a pressure chamber fillable with a fluid, and an actuating member for driving the engaging element in accordance with a pressure of the fluid in the pressure chamber.

BACKGROUND

Press brakes are machines used for bending or folding sheet material, such as metal sheets. For that purpose, press brakes include a bottom beam and a top beam, which are movable with respect to each other. The top and bottom beams both hold tools, between which a workpiece is provided for bending. In general, bending tools of a press brake are exchangeable to allow making different types of bends or folds, and to allow servicing the tools. Therefore, press brakes are provided with a clamping system which can releasably clamp the tools. Clamping systems may be provided on the top beam of the press brake, on the bottom beam, or on both.

Two types of press brakes can be distinguished. The first type has a clamping system that is an integral part of either the top or bottom beam. A further clamping system may or may not be provided for the other of the top or bottom beam. Such a clamping system, that is an integrated one, can not be detached from its top or bottom beam, and is itself thus not exchangeable with another clamping system, whereas the tools the clamping system can hold are exchangeable. The second type has an exchangeable clamping system that can be fixedly connected to either the top beam or bottom beam. A further clamping system may or may not be provided for the other of the top or bottom beam. The exchangeable clamping system allows exchanging tools, but can also be detached from its top or bottom beam, for instance for maintenance or for exchanging it for another clamping system. This is in the art used to make one press brake suitable for different tooling types, which may require different clamping systems, and/or to service the clamping system. Further clamping systems exist that can be clamped by other clamping systems as if they were a tool. Such clamping systems can for instance be clamped by a system for tools of a first type, whereas they themselves can clamp tools of a second type, so that such clamping systems act as an adaptor between a clamping system and a tool that would otherwise be incompatible.

SUMMARY

The invention relates to clamping systems integrated with press brakes, be it in the bottom beam or the top beam, exchangeable clamping systems, and clamping systems acting as an adaptor.

A press brake and a clamping system therefor are known, for instance from applicant's earlier application WO 2010/056110 A1, which describes a clamping device for clamping a tool. The clamping device includes an actuated member and an engaging member. The actuated member is driven for instance hydraulically or pneumatically.

Although the clamping device described in WO 2010/056110 A1 has performed satisfactory, and to this day still does, a need exists to further improve the clamping device. In particular, the need exists to provide a clamping system that requires less servicing and/or inspection, or that is more reliable.

Therefore, the invention aims to provide a clamping system that requires less servicing and/or inspection, or that is more reliable.

According to the invention, this aim is achieved by a clamping system for a press brake according to the preamble, characterized in that the pressure chamber or a cavity housing the pressure chamber is integrally formed in the elongate beam.

To the best of applicant's knowledge, press brakes so far have had cavities for cylinders arranged in a separate body fixed to the elongate beam. This not only creates the need to provide a reliable fixing of the separate body to the elongate beam, but in many cases also requires suitable sealing of the separate body to the elongate beam. Even though adequate fixing and sealing techniques exist, both the fixing and the sealing remain points of possible failure, and must as such be serviced and/or inspected regularly to avoid failure of or damage to the clamping system. By forming the pressure chamber or a cavity housing the pressure chamber integrally in the elongate beam, no separate body is needed. Accordingly, there is no fixing and/or a sealing of such a body which could constitute failures. Therefore, the clamping system is able to operate more reliably, and/or requires less servicing and/or inspection.

Additionally, forming said pressure chamber or said cavity integrally in the elongate beam, as opposed to in a separate body which is in turn fixed to the elongate beam, aids in avoiding tolerance issues. In fact, introducing a separate body would introduce an additional interface with its own tolerance. Thus, deviations from an ideal position of said pressure chamber or said cavity could add up to the further tolerance introduced at the interface of the separate body, thereby increasing the error in the positioning of said pressure chamber or cavity. By avoiding the separate interface the pressure chamber or cavity can therefore be positioned more accurately.

Additionally or alternatively, forming the pressure chamber or cavity integrally in the elongate beam may make it possible to produce the clamping system relatively cost effectively.

It is noted the fluid may be a liquid or a gas.

The pressure chamber can include an inlet and/or outlet, or a combined in- and outlet, for introducing fluid into the pressure chamber and letting fluid out respectively. The pressure chamber may be sealed apart from any inlet and/or outlet. Accordingly, the pressure chamber can be configured to hold a fluid under pressure.

Integrally formed may herein be understood as being part of the same, single piece. As such, no separate piece or component need be attached to the elongate beam in order to provide the pressure chamber or the cavity housing the pressure chamber.

In particular, the pressure chamber or the cavity may be integrally formed in the elongate beam in its entirety. As such, the pressure chamber or the cavity may not require any additional piece fixed to the elongate beam to form and/or seal a pressure chamber.

In an embodiment of the clamping system the actuating member is movable within said pressure chamber or the cavity.

In this embodiment, the actuating member can move in the pressure chamber or the cavity, so that the actuating member takes up less space outside the pressure chamber or the cavity. Accordingly, this embodiment allows for a particularly compact construction.

Providing a compact construction may aid in reducing a risk of a workpiece colliding with the press brake. As an example, when a workpiece is to be bent multiple times, for instance in different locations, it may fold back towards the elongate beam. The elongate beam could in that case limit the size of the workpiece and/or the amount of bends that can be made in the workpiece, before the elongate beam blocks the workpiece while bending. As such, compactly constructing the press brake is important to allow as much room for the workpiece as possible, so that complex geometries, with many fold, and/or relatively large workpieces may be bent using the press brake. In another embodiment of the clamping system, said cavity or pressure chamber debouches to an exterior of the elongate beam.

The actuating member being movable in the pressure chamber or cavity allows the actuating member to constitute or comprise a piston of pneumatic or hydraulic drive system. Advantageously, this reduces the number of parts needed. The actuating member may be movable between an active position, in which it urges the clamping element towards the first position, and an inactive position in which it allows the clamping element to move to the second position.

In the active position, the pneumatic or hydraulic pressure may be relatively high, whereas in the inactive position, the pneumatic or hydraulic pressure may be relatively low. Thus, pressure may be used to move the actuating member to its active position.

The actuating member may be movable in a direction which is parallel to a pressing direction defined by the clamping system, e.g. corresponding to the pressing direction of the press brake. The pressing direction may correspond to a depth direction of a depth direction of the receiving space in the elongate beam.

In particular, the actuating member may act directly upon the clamping element. As such no further components are needed to drive the clamping element, which aids in achieving an accurate construction, thereby profiting from the avoidance of tolerance issues explained above.

It is noted that the actuating member moving in the pressing direction combined with the actuating member acting directly on the clamping element allows for a particularly compact construction whilst avoiding tolerance issues caused by additional components which would otherwise be needed.

The direct interaction between actuating member and clamping element can be achieved e.g. when at least one of the clamping element and the actuating member is provided with an engagement surface for engaging the other of the clamping element and the actuating member, wherein at least a part of the engagement surface is inclined with respect to a direction of movement of the respective element.

Such an inclined engagement surface provides a transmission between the clamping element and the actuating member, so that the clamping element and the actuating member may be placed at an angle with respect to each other, which in turn allows a relatively compact construction of the clamping system.

An angle at which the engagement surface is inclined may be chosen to select a suitable transmission ratio between movement of the actuating member and the clamping element. The angle may even vary, smoothly or abruptly, over the engagement surface, so as to provide a different transmission ratio at different positions of the engagement surface. In particular, the engagement surface may be curved, or comprise two sections with a different angle of inclination.

When the cavity or pressure chamber debouches to the exterior, the debouchment can be used to introduce components into the cavity or the pressure chamber. For instance, a piston may be inserted into the pressure chamber, or a cylinder may be inserted into the cavity.

In yet another embodiment of the clamping system, the clamping system further comprises a cover for covering at least a debouchment of said cavity or pressure chamber.

Such a cover can protect the pressure chamber and/or cavity, and possibly moving parts of the clamping system against e.g. dirt and/or increase safety of the clamping system by making the moving parts inaccessible to workers.

In yet another embodiment of the clamping system, the clamping system comprises multiple interconnected pressure chambers or cavities.

Multiple pressure chambers or cavities can be used to drive multiple actuating members in order to move multiple clamping elements, so that tools of varying length can be clamped, and/or so that multiple tools can be clamped at the same time. In the case of pressure chambers, interconnecting them allows equalizing pressure in every pressure chamber, thereby making it possible to drive multiple pressure chambers by inserting and/or letting out fluid into a single pressure chamber. In the case of the cavities, interconnecting them allows to provide e.g. conduits and control lines for e.g. cylinders placed in the cavities.

The multiple pressure chambers or cavities may be lined up in a longitudinal direction of the elongate beam.

In yet another embodiment of the clamping system the pressure chambers or cavities are interconnected internally.

By connecting the pressure chambers or cavities internally, further points of possible failure are avoided, and less sealing is needed as compared to the prior art, where cavities are interconnected via conduits external to the elongate beam. Such conduits require sealing to the elongate beam, which sealing introduces a possible point of failure. Moreover the conduits provided externally are susceptible to damage.

In particular, when the conduits carry hydraulic or pneumatic fluid, it takes a relatively long amount of time for the fluid to move through the conduits, and the conduits impose a relatively high resistance to flow on the fluid. Thus, by providing said internal connection, less time and/or pressure may be needed to move the hydraulic or pneumatic fluid, which in turn may aid in moving the clamping element faster. A tool can thereby be released and/or replaced faster.

In yet another embodiment of the clamping system, the clamping system further comprises a channel in the elongate beam connected to the pressure chamber or cavity for feeding and/or returning fluid to the pressure chamber or cavity.

By feeding and/or returning fluid to the cavity or pressure chamber via the channel, the pressure chamber or a cylinder housed in the cavity can be used as part of a pneumatic or hydraulic drive means for the actuating member.

In yet another embodiment of the clamping system, wherein the pressure chamber is integrally formed with the elongate beam, the actuating member comprises a piston moveable in the pressure chamber.

In this embodiment, the pressure chamber is formed integrally in the elongate beam, and the piston is moveable in the pressure chamber. The piston is thus moveable directly in the pressure chamber. Accordingly, the pressure chamber can form a cylinder of a pneumatic or hydraulic drive means to drive e.g. the actuating member. No further separate cylinder needs to be provided, which reduces the amount of components needed, and thereby also reduces the amount of points of possible failure.

In yet another embodiment of the clamping system, wherein the cavity is formed integrally in the elongate beam, the clamping system further comprising a cylinder housed in said cavity, the cylinder defining the pressure chamber, wherein the actuating member comprises a piston movable in the cylinder.

In this embodiment, the cavity is used to house a cylinder, which can be used as part of a pneumatic or hydraulic drive means for driving e.g. the actuating member. Using a cylinder separate from the elongate beam reduces the tolerances constraints in dimensioning the cavity, as only the cylinder and the piston need to be fitted and sealed together with relatively small tolerance. Accordingly, the cavity can be produced in the elongate beam relatively easily and/or quickly and/or cost effectively. Moreover, providing a separate cylinder in the cavity reduces and/or removes sealing requirements on the cavity.

In yet another embodiment of the clamping system the pressure chamber is defined by a deformable wall arranged in said cavity.

By forming the pressure chamber out of a deformable wall, the pressure chamber may perform an expanding and contracting deformation upon supply and removal of fluid therefrom. As such, the deformable wall can be used to drive e.g. the actuating member in motion, for instance by pushing it towards the active position when extending.

A flexible hose may be provided to form the deformable wall. The flexible hose may extend through multiple cavities, in order to provide interconnected pressure chambers with deformable walls in the multiple cavities.

In yet another embodiment of the clamping system the pressure chamber is configured to receive a hydraulic fluid.

Accordingly, the pressure chamber may be used as part of a hydraulic drive means. The pressure chamber may form a hydraulic cylinder or hydraulic chamber.

In yet another embodiment of the clamping system the pressure chamber is configured to receive a pneumatic fluid.

Accordingly, the pressure chamber may be used as part of a pneumatic drive means. The pressure chamber may form a pneumatic cylinder or pneumatic chamber.

In yet another embodiment of the clamping system, the actuating member is movable between an active position, in which it urges the clamping element towards the first position, and an inactive position in which it allows the clamping element to move to the second position, the clamping system further comprising a first biasing member acting on the actuating member for biasing the actuating member towards its inactive position.

The applicant has found that a relatively large part of the time needed for changing tools is taken up by displacing the clamping element towards its second position, in order to release the tool. To move the clamping element towards its second position, for instance in the case of the actuating member being pneumatically or hydraulically driven, pneumatic or hydraulic pressure on the actuating member needs to be stopped, and pneumatic or hydraulic fluid may need to flow back, to allow the actuating member to return to its inactive position. It may however take up to over ten seconds for the pneumatic or hydraulic fluid to have receded sufficiently for releasing the tool. To facilitate the pneumatic or hydraulic fluid receding, a first biasing member is provided that acts on the actuating member. The biasing member biases the actuating member to its inactive position, thereby forcing out pneumatic or hydraulic fluid upon sufficient release of pneumatic or hydraulic pressure. As a result, the time needed to move the actuating member back to its inactive position, and thus for allowing release of the tool, can be shortened, for instance to a period of approximately one to two seconds.

The first biasing member may of course also be used to perform a similar function when drive means other than pneumatic or hydraulic drive means are used.

It is noted that the first biasing member acting on the actuating member, instead of for instance on the clamping element, may provide a relatively large space for the first biasing member. In particular, a first biasing member acting on the actuating member may be relatively long and/or relatively wide. Accordingly, the first biasing member may therefore be relatively large, which in the case of e.g. a compression spring allows for a relatively high spring constant, so that the compression spring may provide a relatively large biasing force, which aids in reducing the time needed to move the actuating member. The length of the spring may also or alternatively allow a relatively large range of motion of the actuating member while being biased by the spring.

The relatively large range of motion of the actuating member may be of particular importance in cases where a relatively large stroke of the clamping element is needed. Clamping systems exist that include a protrusion acting as a hanger or hook on the inside of the receiving space, upon which a tool can be supported and/or hung. Since the tool needs sufficient space inside the receiving space to maneuver it around the protrusion for inserting or removing the tool, the receiving space is relatively broad as compared to the tool. Such clamping systems require a relatively large stroke of the clamping element, since the clamping element must traverse at least partly the relatively broad receiving space.

It is noted that a force provided by the first biasing member may need to be overcome to move the actuating member to its active position. Thus, the total force needed to clamp a tool is increased by the first biasing member. This can be achieved by selecting suitably strong drive means, such as hydraulic or pneumatic drive means, to drive the actuating member.

The first biasing member acting on the actuating member may herein be understood as that the first biasing member acts first on the actuating member. Of course, the actuating member may in that case act for instance on the clamping element or for instance drive means. It must be understood that biasing means acting first on for instance the clamping element, whilst the clamping element acts on the actuating member, are not herein understood to act on the actuating member. Accordingly, the first biasing member may act on the actuating member directly.

The first biasing means may act on any element that moves in the same direction and with the same speed as the actuating member, e.g. any element that is fixedly connected to the actuating member.

The invention also relates to a press brake comprising at least one clamping system as described above. The clamping system may have any of the above-described features, alone or in any suitable combination.

The clamping system may be arranged in a top beam of the press brake, in a bottom beam of the press brake, or in both. The clamping system may be a separate, exchangeable clamping system, often referred to into the art as clamping beam, or may be an integral part of the press brake.

BRIEF DESCRIPTION OF THE DRAWINGS

The invention will be further elucidated with reference to the attached drawings, in which:

FIGS. 3B, 3C, 5, 6, 7B, 7C, 8, 9 and 12 show views from the same side as that of FIGS. 1A and 2A.

In the figures, like elements are referred to with like reference numerals. Corresponding elements of different embodiments are referred to with reference numerals increased by a multiple of one hundred (100).

DETAILED DESCRIPTION

Figure 1A:
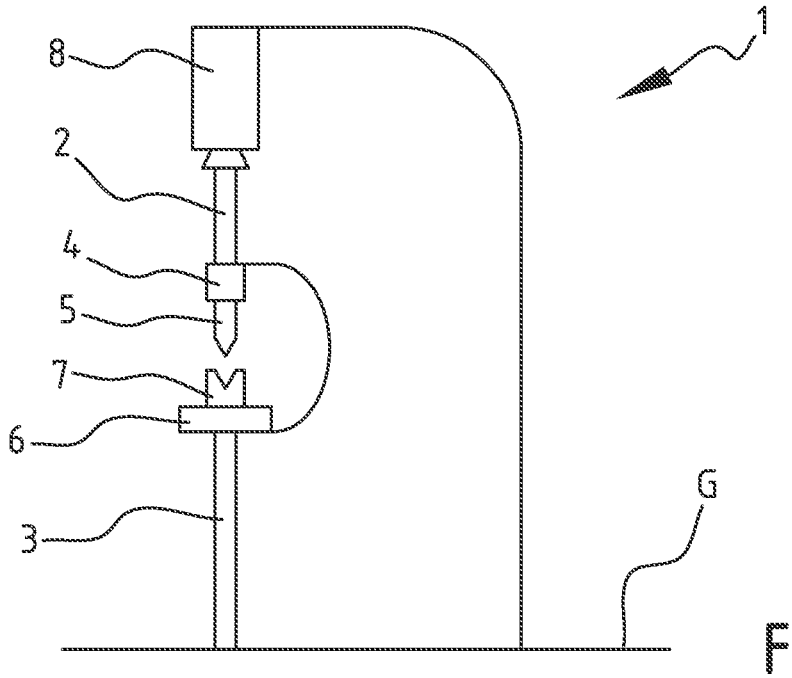
FIGS. 1A and 1B show schematically a cross-sectional side view and a front view respectively of a press brake with an exchangeable clamping system.
Figure 1B:
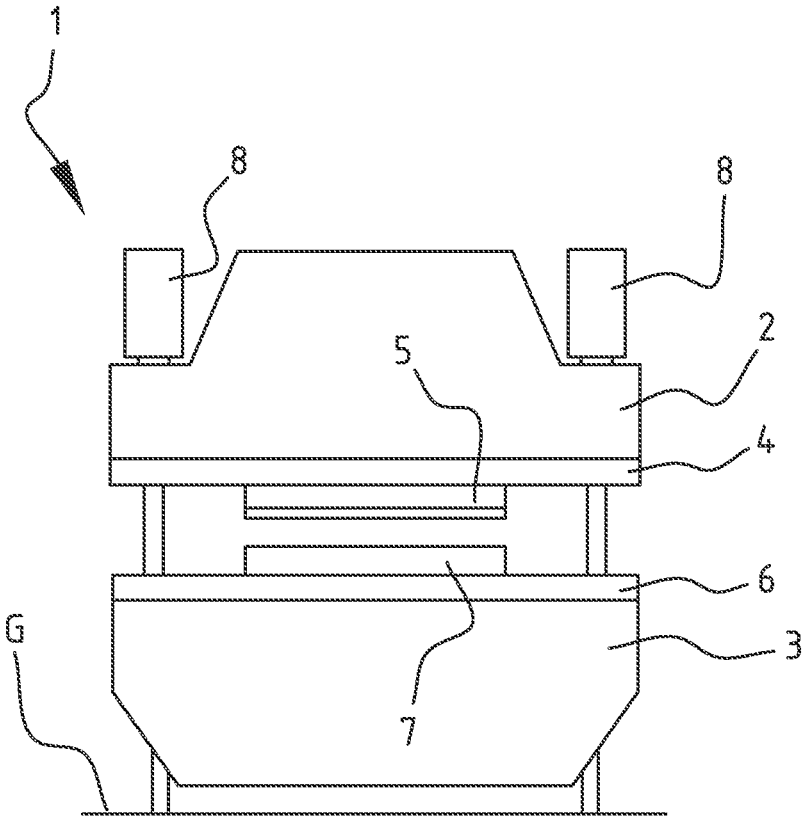

FIGS. 1A and 1B show a press brake 1 placed on a ground surface G. The press brake 1 includes a top beam 2 and a bottom beam 3. The top beam 2 is provided with a top clamping system 4. The clamping system releasably holds a top tool 5. The bottom beam 3 is provided with a bottom clamping system 6, which releasably holds a bottom tool 7. The top beam 2 and the bottom beam 3 are moveable towards and away from each other by means of hydraulic systems 8. Accordingly, the top and bottom tools 5, 7 are also moveable towards and away from each other. To bend sheet metal, the sheet is inserted between the tools 5, 7 which are then moved towards each other. The top tool 5 then forces the sheet metal into the bottom tool 7 in order to deform the sheet metal by bending. After bending, the tools 5, 7 are moved away from each other by moving the top beam 2 via the hydraulic systems 8. The clamping systems 4, 6 are releasably attached to the top and bottom beam 2, 3 respectively via a suitable locking system. Accordingly, the clamping systems 4, 6 can be exchanged for clamping systems suitable for other tools, or the clamping systems 4, 6 can be taken out for servicing them.

Figure 2A:
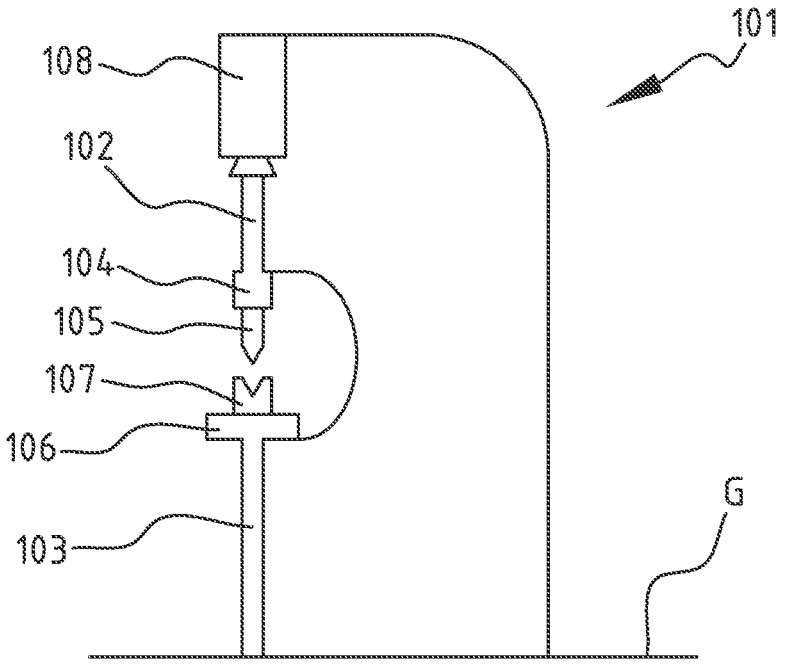
FIGS. 2A and 2B show schematically a cross-sectional side view and a front view respectively of a press brake with an integrated clamping system.
Figure 2B:
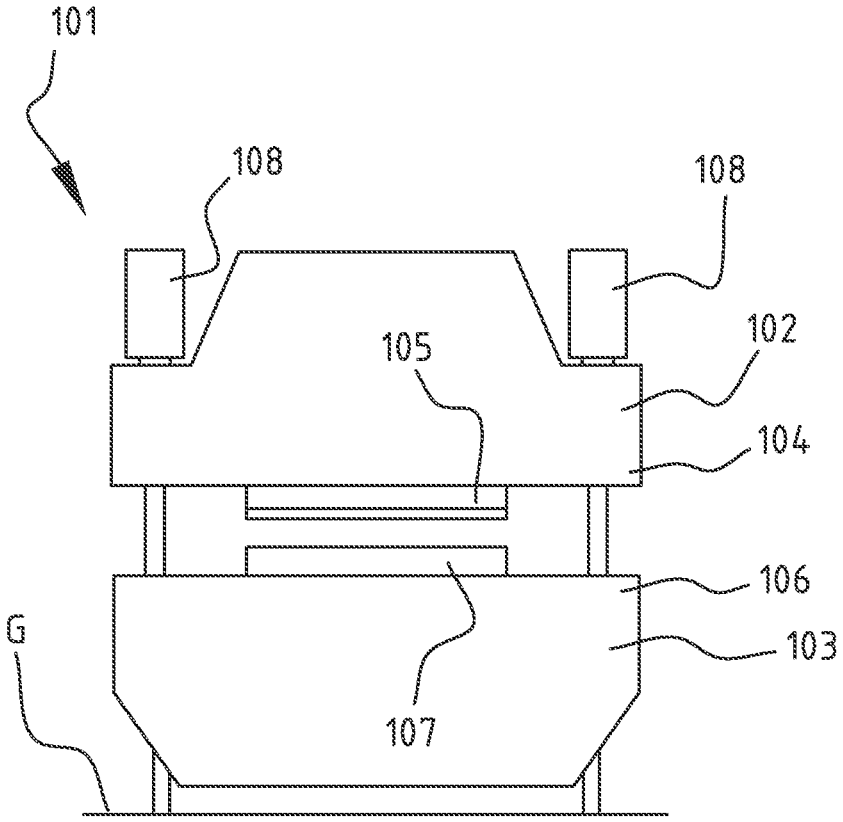

FIGS. 2A and 2B show a similar press brake 101, which will be described here only in as far as it differs from the press brake 1 in of FIGS. 1A and 1B. The clamping systems 104, 106 of the press brake in FIGS. 2A and 2B are integrated with the top and bottom beams 102, 103 respectively. As such, the clamping systems 104, 106 are not exchangeable. The tools 105, 107 held by the clamping systems 104, 106 are exchangeable.

Figure 3A:
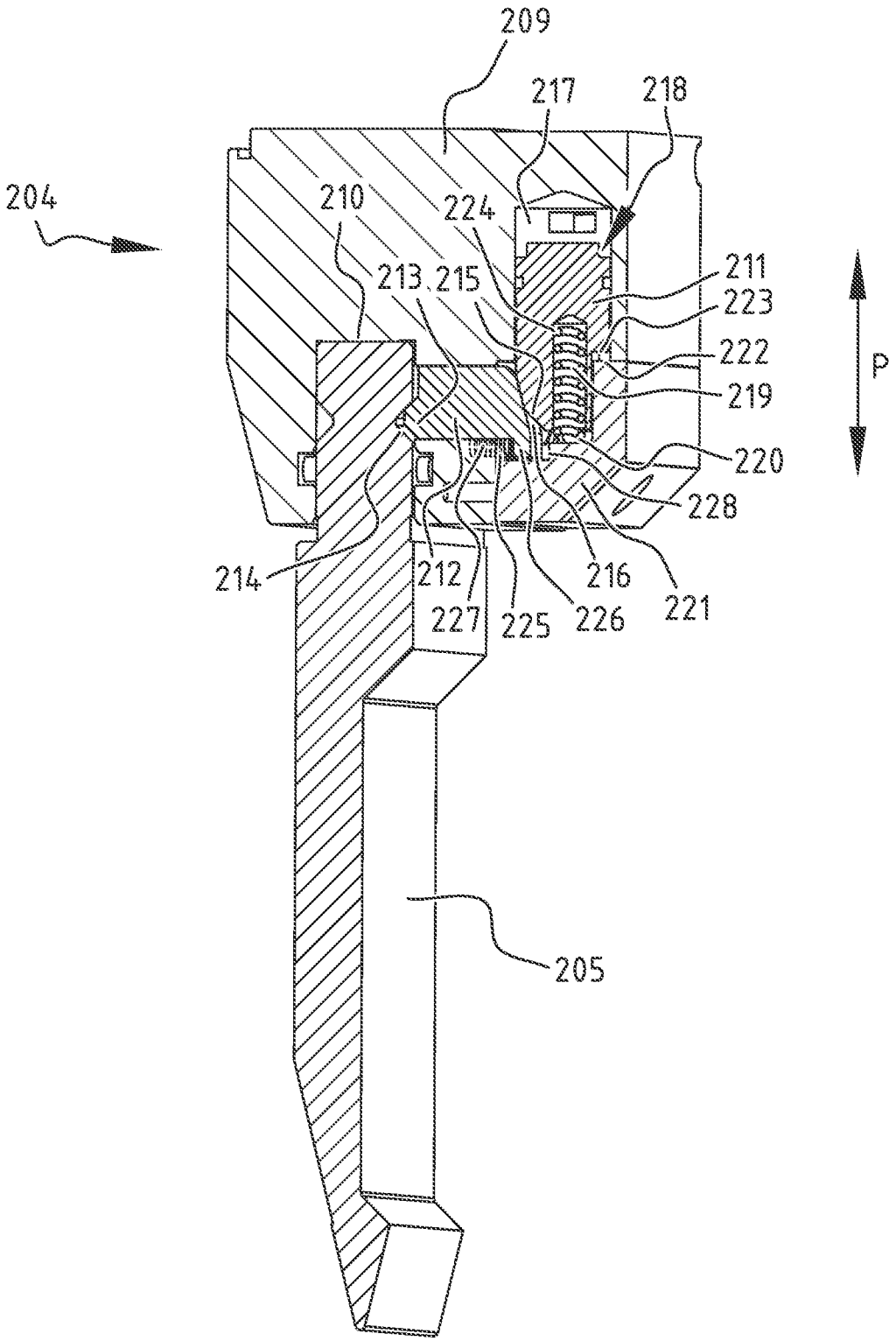
FIGS. 3A-3C show schematically a clamping system and a tool in perspective and transversal cross-sectional views.
Figure 3B:
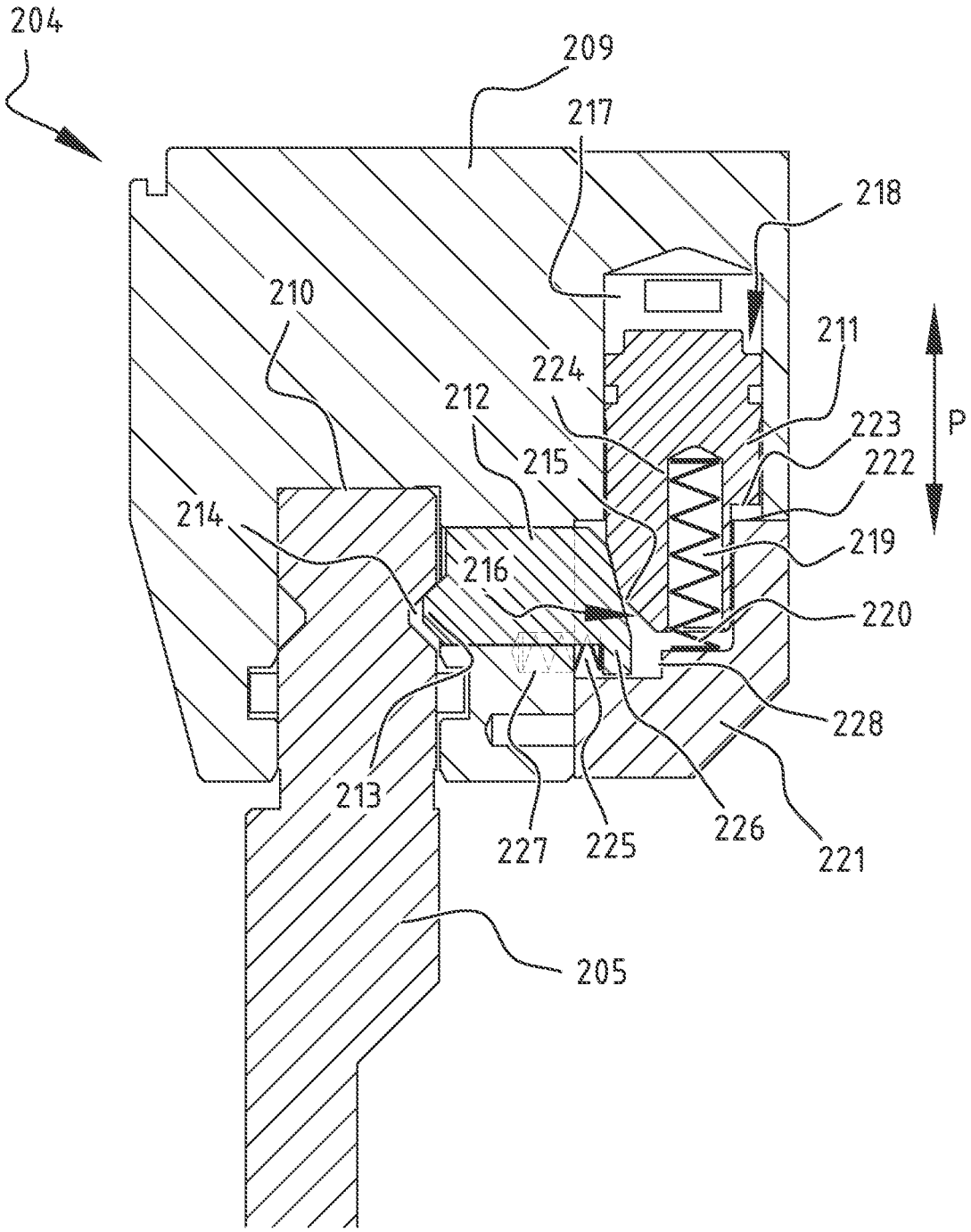
Figure 3C:
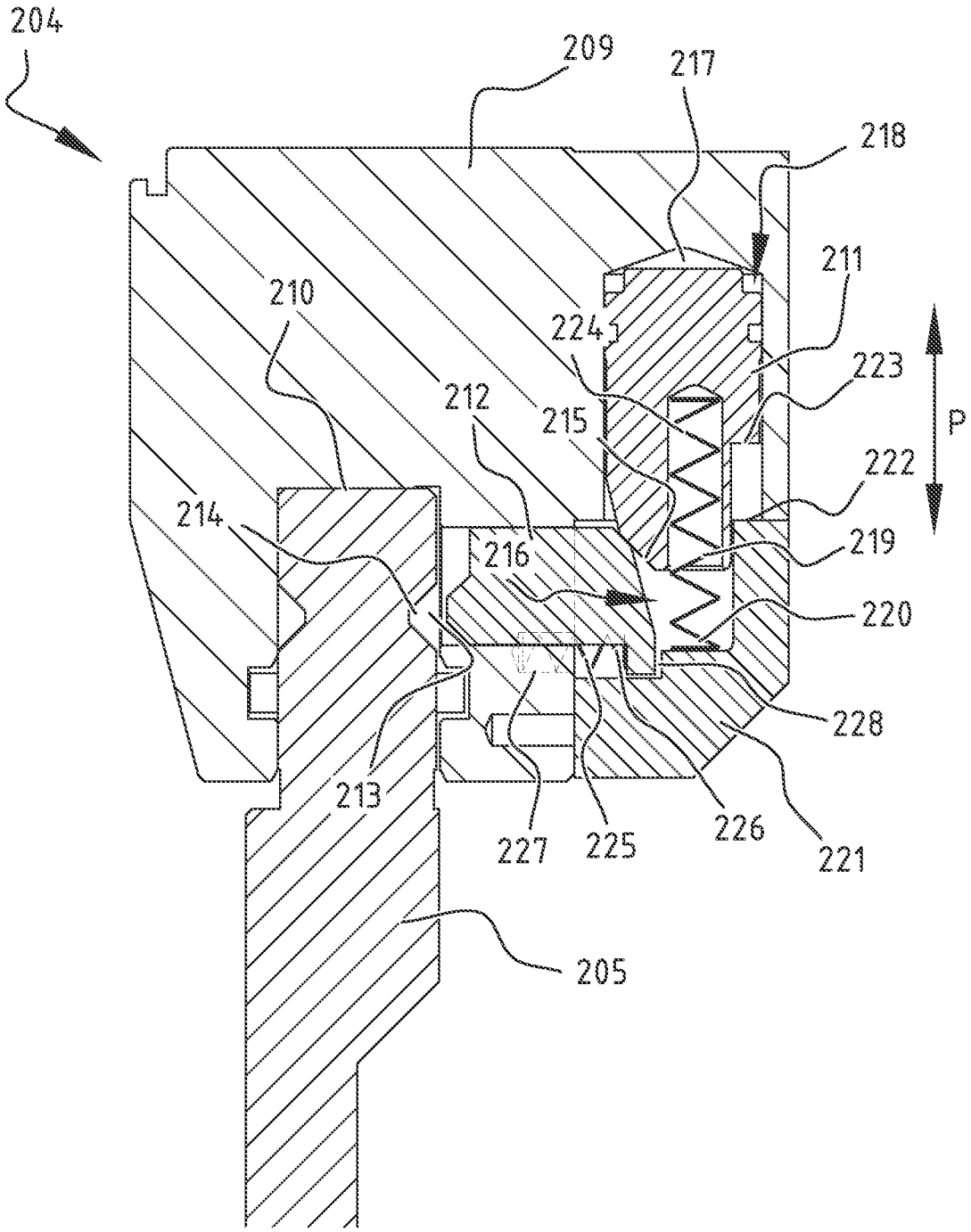

FIGS. 3A-3C show a clamping system 204, that could for instance be used in a press brake shown in FIGS. 1A-2B. The clamping system 204 has as a main body an elongate beam 209. A receiving space 210 in the elongate beam 209 accommodates a part of tool 205. The clamping system further comprises an actuating member 211 and a clamping element 212. The actuating member 211 is moveable upwards, to an inactive position, and downwards, to an active position. The clamping element 212 is moveable between a first position, in which it extends into the receiving space 210 for engaging on the tool 205, and a second position, in which it is retracted away from the receiving space 210 to release the tool. The clamping element 212 has an engaging tip 213 which cooperates with an engaging recess 214 in the tool 205 in order to clamp the tool 205 securely in the receiving space 210. In the active position, the actuating member 211 engages the clamping element 212 and urges it towards the receiving space 210. FIG. 3B shows the actuating member 211 in the active position, so that the tool 205 is clamped in the receiving space 210 by the clamping element 212. The actuating member 211 has for the purpose of engaging the clamping element 212 an inclined engaging surface 215 which engages on a similarly cooperating inclined engaging surface 216 of the clamping element 212. Accordingly, when the actuating member 211 moves to its active position, i.e. downwards in the figures, the engaging surface 215 of the actuating member 211 engages the engaging surface 216 of the clamping element 212 and, due to its inclination, urges the clamping element 212 to its first position, i.e. leftwards in the figures. FIG. 3C shows the actuating element 211 in its inactive position, with the clamping element 212 retracted away from the receiving space 210 to its second position, thereby releasing the tool 205.

The actuating member 211 is movably arranged in a pressure chamber 217. The pressure chamber 217 is made directly into the elongate beam 209, which also has the receiving space 210. The pressure chamber 217 is thus integrally formed in the elongate beam 209. The actuating member 211 is provided with sealing means 218 which seal the actuating member 211 to the wall of the pressure chamber 217, i.e. to the inside of the elongate beam 209. As such, the actuating member 211 works as a piston moveable in the pressure chamber 217, which accordingly works as a cylinder. Accordingly, the actuating member 211 can be pushed towards its active position by introducing a fluid in the pressure chamber 217. The pressure chamber 217 of this clamping system 204 is adapted for receiving a hydraulic liquid as pressure fluid, in order to move the actuating member 211.

The clamping system 204 is provided with a first biasing member in the form of a first compression spring 219. The first compression spring acts on the actuating member 211. The first compression spring 219 is arranged vertically, which corresponds to the pressing direction P defined by the clamping system 204, and the depth direction of the receiving space 210. The first compression spring 219 biases the actuating member 211 upwards, i.e. towards its inactive position. Accordingly, when pressure of the hydraulic liquid in the pressure chamber 217 is stopped, the first compression spring 219 pushes the actuating member 211 upwards further into the pressure chamber 217 thereby forcing the hydraulic fluid to flow out of the pressure chamber 217. The first compression spring 219 supports on a support 220 provided by a cover 221. The cover 221 covers clamping element 212, the actuating element 211 and the pressure chamber 217. The cover 221 also forms a first stop 222 for the actuating member 211 to hit, in order to limit movement of the actuating member 211 beyond the active position. The actuating member 211 has a movement limiter 223 for engaging the first stop 222. The first compression spring 219 extends partly in a first cavity 224 in the actuating member 211. A second biasing member is provided in the form of a second compression spring 225. The second compression spring 225 is arranged horizontally, i.e. perpendicular to the pressing direction P and a longitudinal direction of the elongate beam 204. The second compression spring 225 acts on the clamping element 212 via a protrusion 226 thereof, the first compression spring 225 extends partly in a second cavity 227 in the elongate beam. The cover 221 also provides a second stop 228 for engaging the protrusion 226 of the clamping element 212, to limit the movement of the clamping element 212 beyond its second position.

Figure 4A:
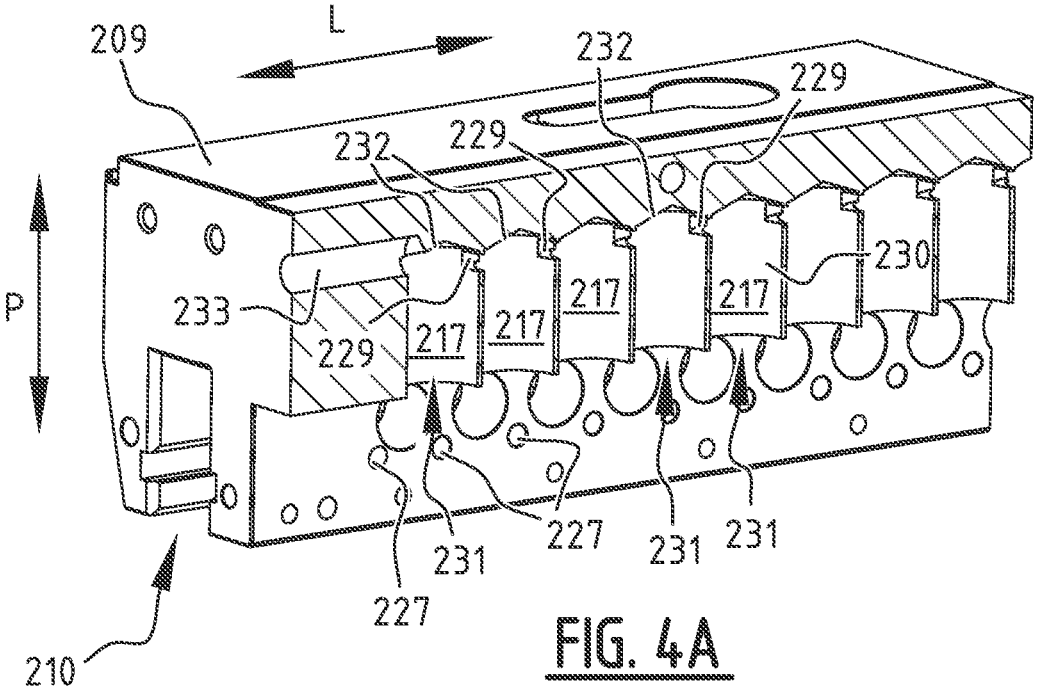
FIGS. 4A and 4B show schematically a perspective view and a longitudinal cross-sectional view of an elongate beam of the clamping system of FIGS. 3A-3C.
Figure 4B:
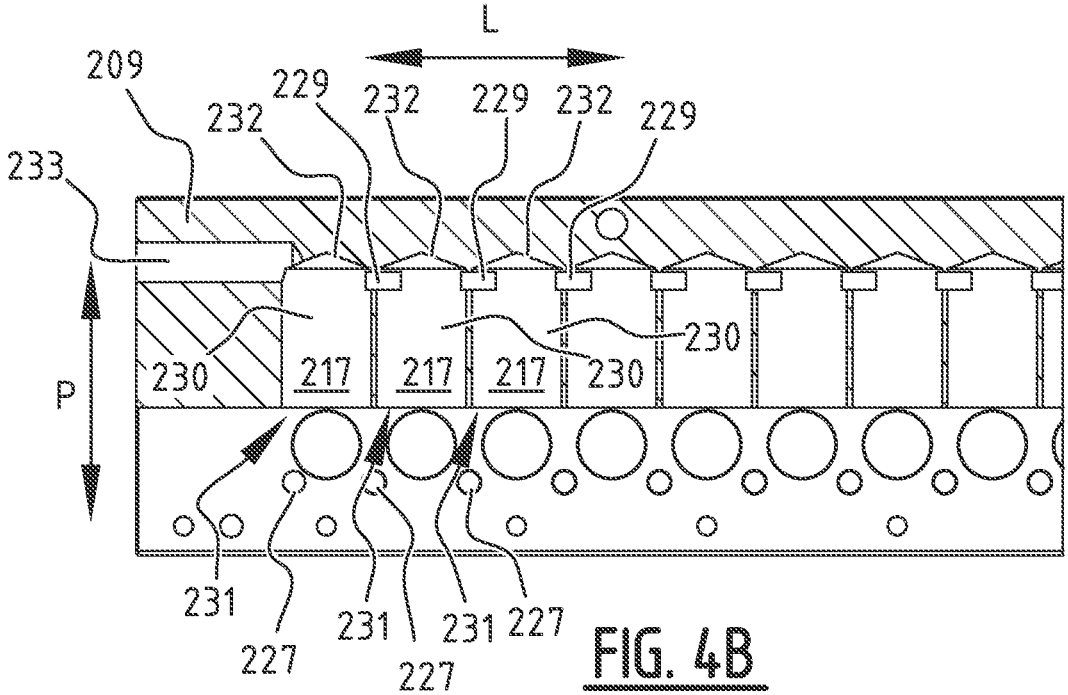

FIGS. 4A and 4B show the elongate beam 209 of the clamping system 204 described above in more detail. Repeating elements in FIGS. 4A and 4B have not been provided with reference numerals in each instance. As can be seen, multiple pressure chambers 217 are lined up in the elongate beam 209 in its longitudinal direction L. The pressure chambers 217 are connect to each other, i.e. interconnected, via interconnections consisting of channels 229 extending between side walls 230 of adjacent pressure chambers 217. The pressure chambers 217 have an opening 231 on one end, and are closed on the other end 232. The channels 229 are provided close to said other end 232. One pressure chamber 217 is connected to the external of the elongate beam 209 via a channel 233. It is visible from FIGS. 4A and 4B, that the pressure chambers 217 are arranged in the elongate beam 209 integrally, in the same piece of material comprising the receiving space 210. The pressure chambers 217 are interconnected internally, since the interconnection is made via channels 229 that do not reach the outside of the elongate beam 209.

Figure 5:
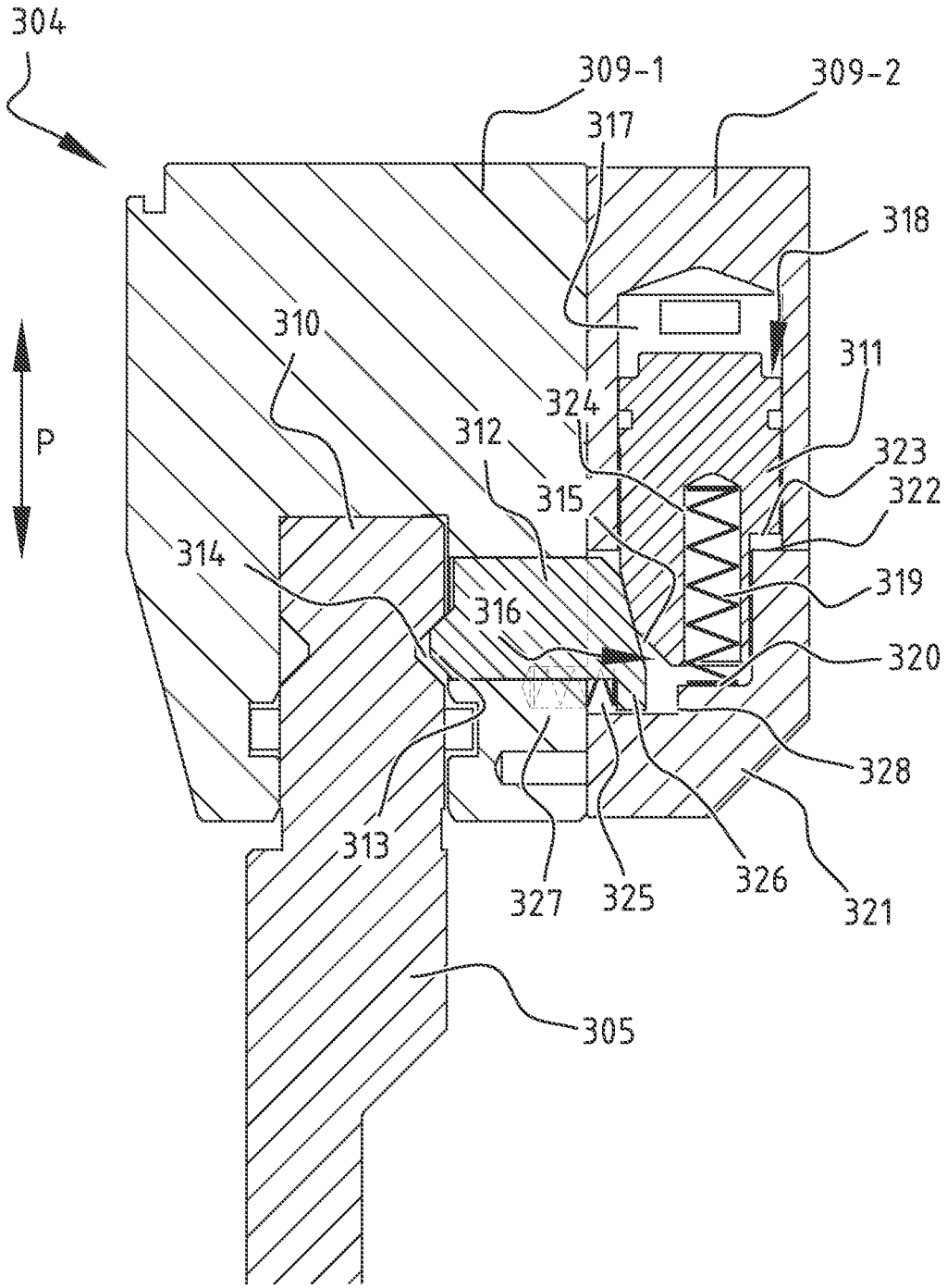
FIG. 5 shows schematically a variation on the clamping system of FIGS. 3A-5.

FIG. 5 shows a clamping system 304 that differs only from the above described clamping system 204 in that its elongate beam 309 is comprised of two separate components 309-1 and 309-2. The main body 309-1 of the elongate beam can be manufactured separate from the auxiliary body 309-2, and attached to it later. The pressure chamber 317 is formed in the auxiliary body 309-2.

Figure 6:
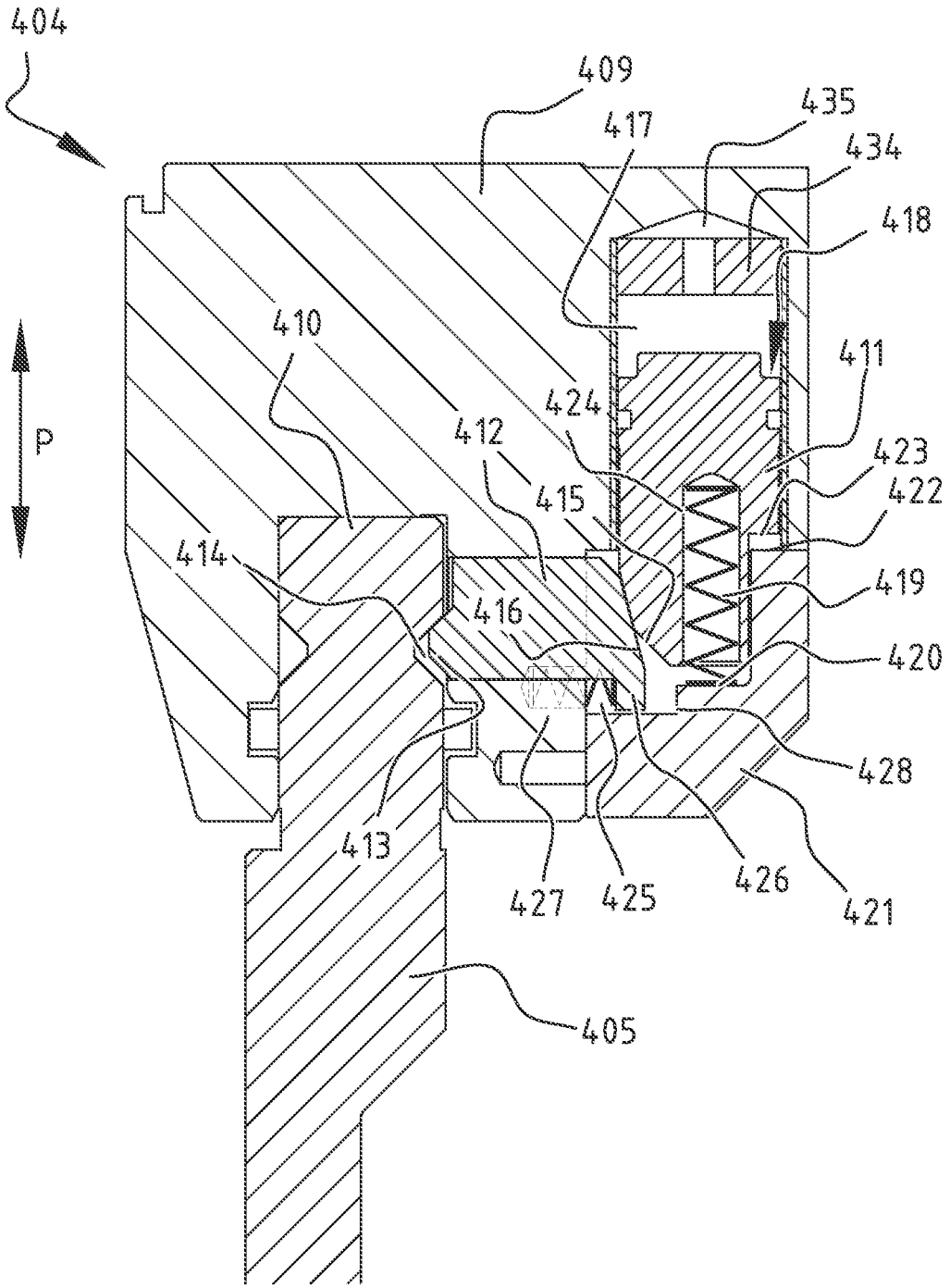
FIG. 6 shows schematically a variation on the clamping system of FIGS. 3A-5.

FIG. 6 shows a clamping system 404 that differs only from the clamping system 204 described in relation to FIGS. 3A-4B in that the pressure chamber 417 is formed within a cylinder 434 which is placed in a cavity 435 in formed integrally the elongate beam 409. It is of course possible to provide the cavity 435 in an auxiliary body as described with respect to FIG. 5, thereby combining the differing features of FIGS. 5 and 6.

Figure 7A:
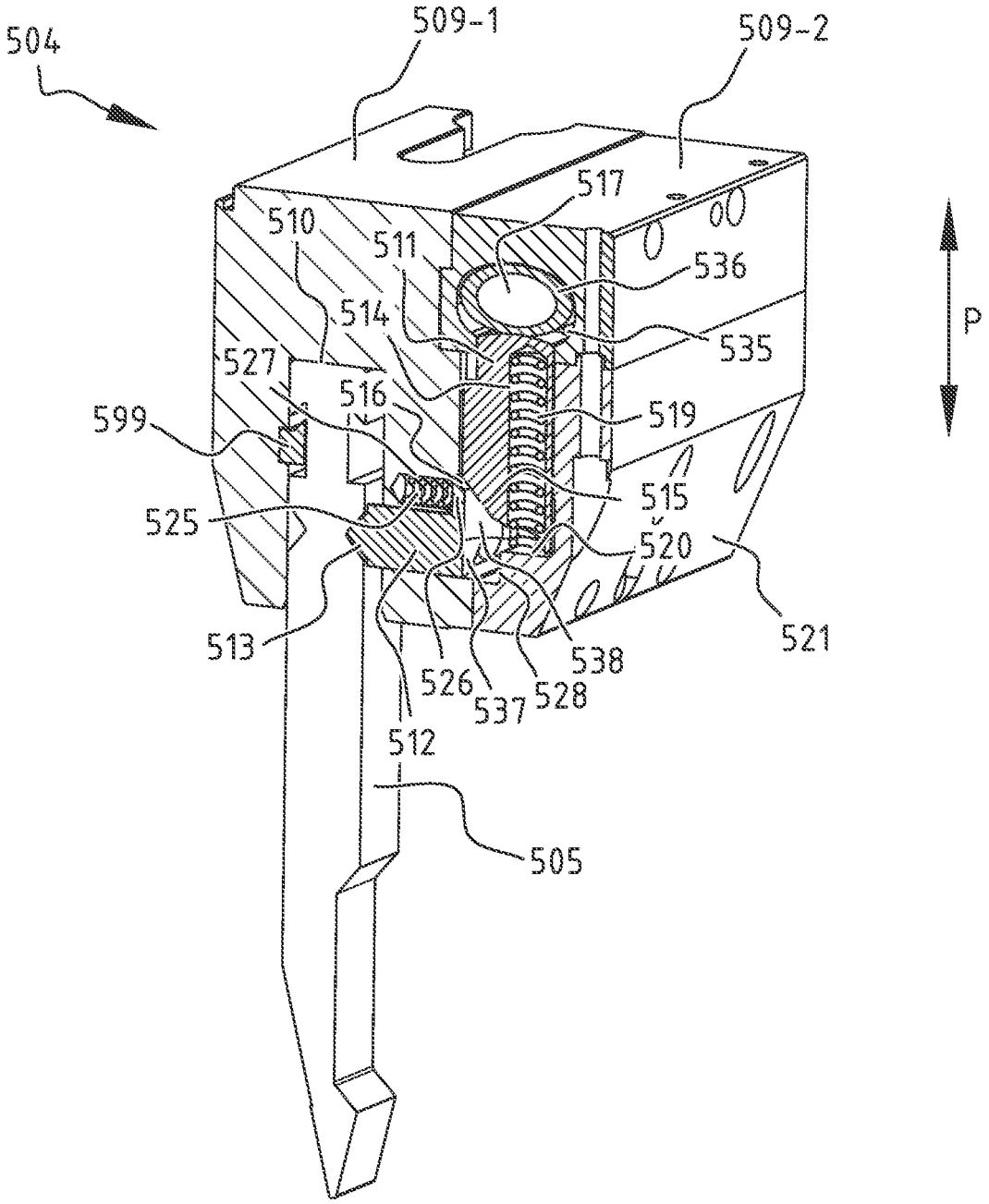
FIGS. 7A-7C show schematically another clamping system and a tool in perspective and side views.
Figure 7B:
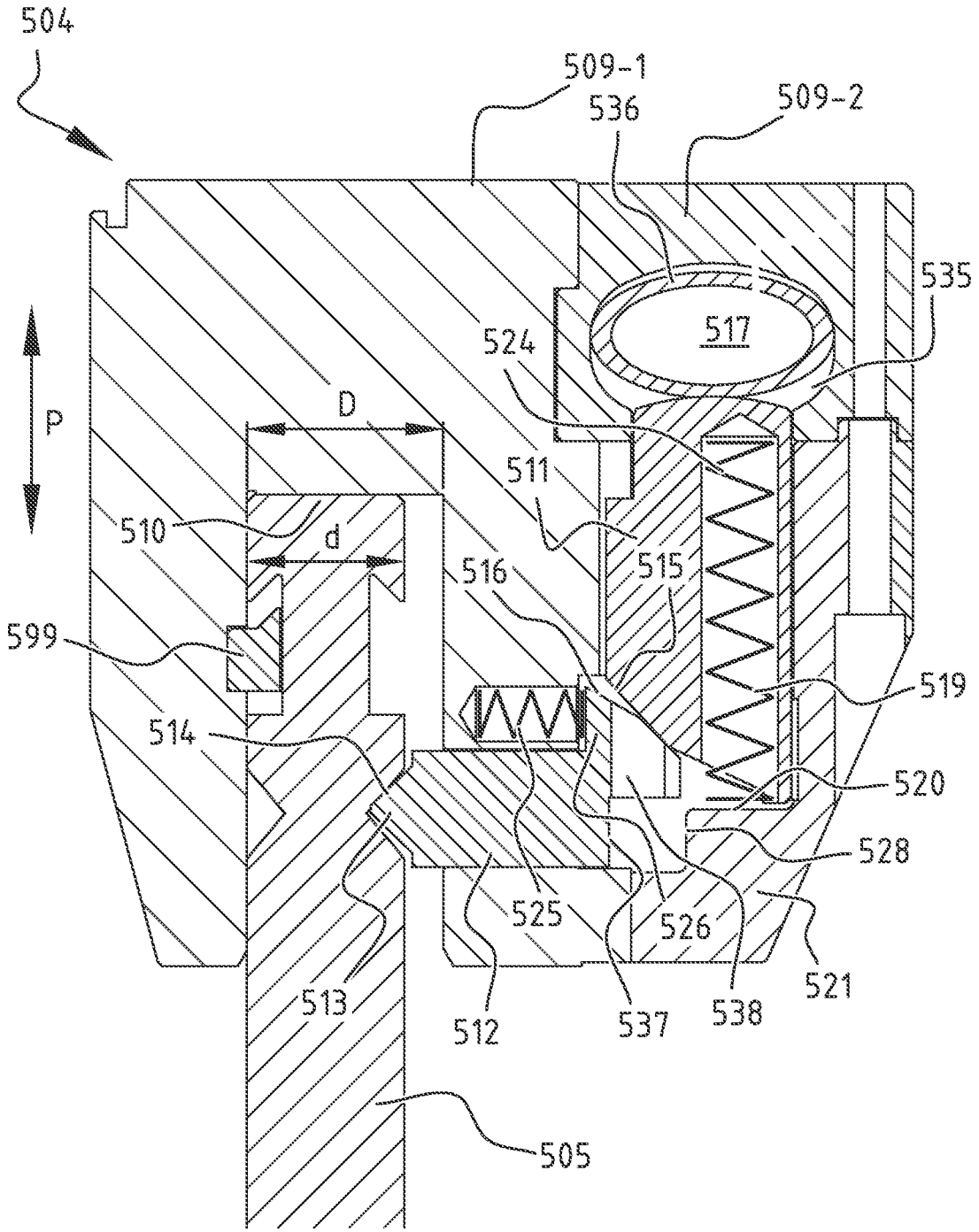
Figure 7C:
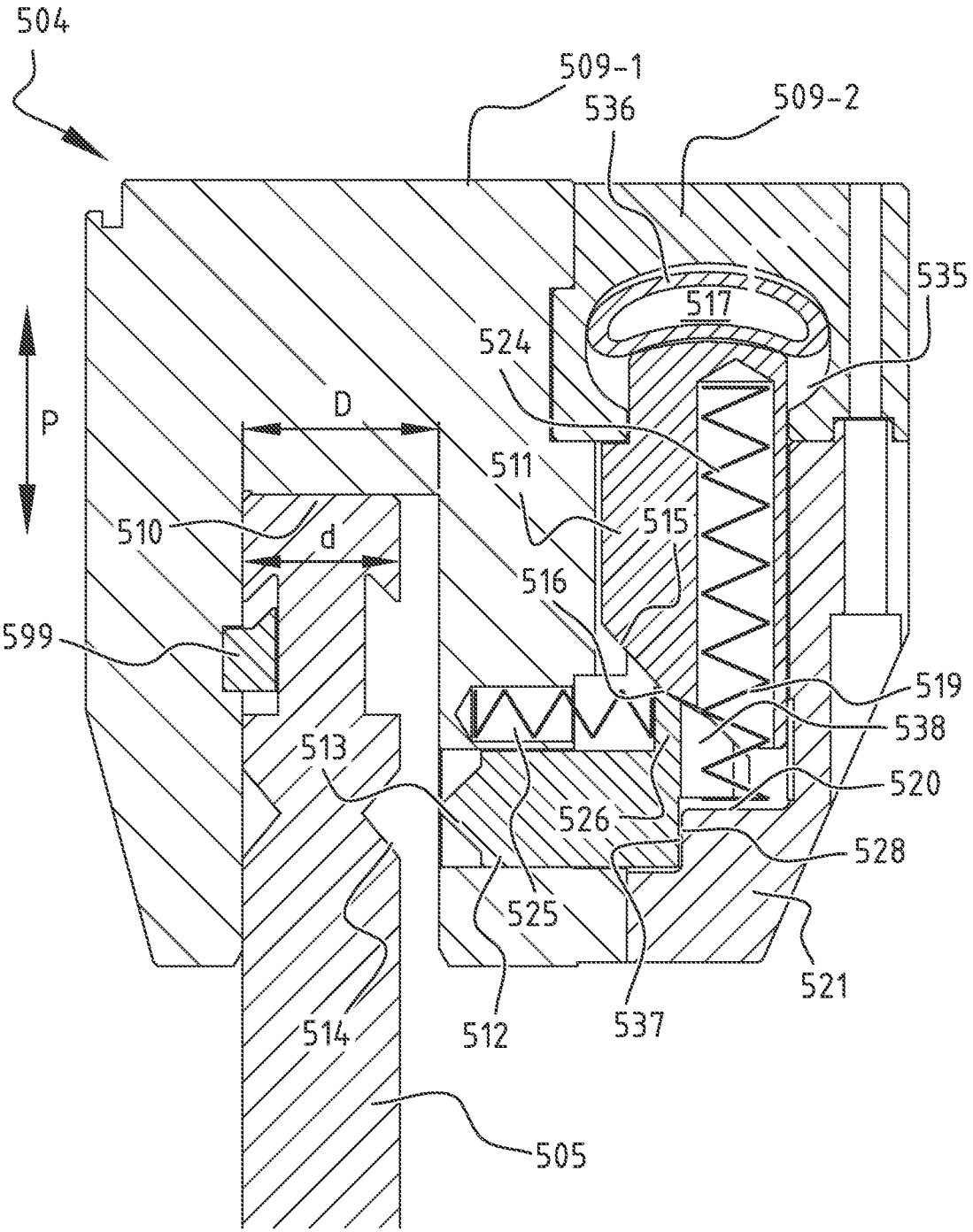

FIGS. 7A-7C show a clamping system 504 that differs only from the clamping system 204 described in relation to FIGS. 3A-4B in the features described below. Firstly, the elongate beam 509-1, 509-2 consists of two separate components 509-1 and 509-2. The main body 509-1 of the elongate beam can be manufactured separate from the auxiliary body 509-2, and attached to it later. The pressure chamber 217 is formed by a pneumatic hose 536 which has a deformable wall. The hose 536 runs in the longitudinal direction L of the elongate beam 509-1, 509-2 through a cavity 535 therein. The hose 536 expands when fluid is pressurized in the pressure chamber 517, and contracts when pressure is released. As the hose 536 expands (see FIG. 7B), it pushes the actuating member 511 to its active position. The first compression spring 519 aids in pushing fluid out of the pressure chamber 517 when pressure therein in lowered, by pushing the actuating member 511 upwards (see FIG. 7C). Moreover, the protrusion 526 of the clamping element 512 is placed on a top side of the clamping element 512 for engaging the second compression spring 525. This leaves free an end surface 537 of the clamping element 512 for engaging the second stop 528. Further, the clamping element 512 is provided with a recess 538 for accommodating the first compression spring 519 when the clamping element 512 is in the second position, i.e. moved towards the right in the figures. No first stop or movement limiter of the actuating member is provided, as was the case in the embodiment of FIGS. 3A-4B. Finally, a protrusion 599 is provided that forms a hook inside the receiving space 510. The protrusion 599 is used to hang the tool 505. For insertion or removal, the tool 505 needs to be moved around the protrusion 599. As such, the receiving space 510 has a relatively large width D as compared to the tool 505 which has a smaller width d. Accordingly, the clamping element 512 has a relatively large stroke for clamping the tool 505.

Figure 8:
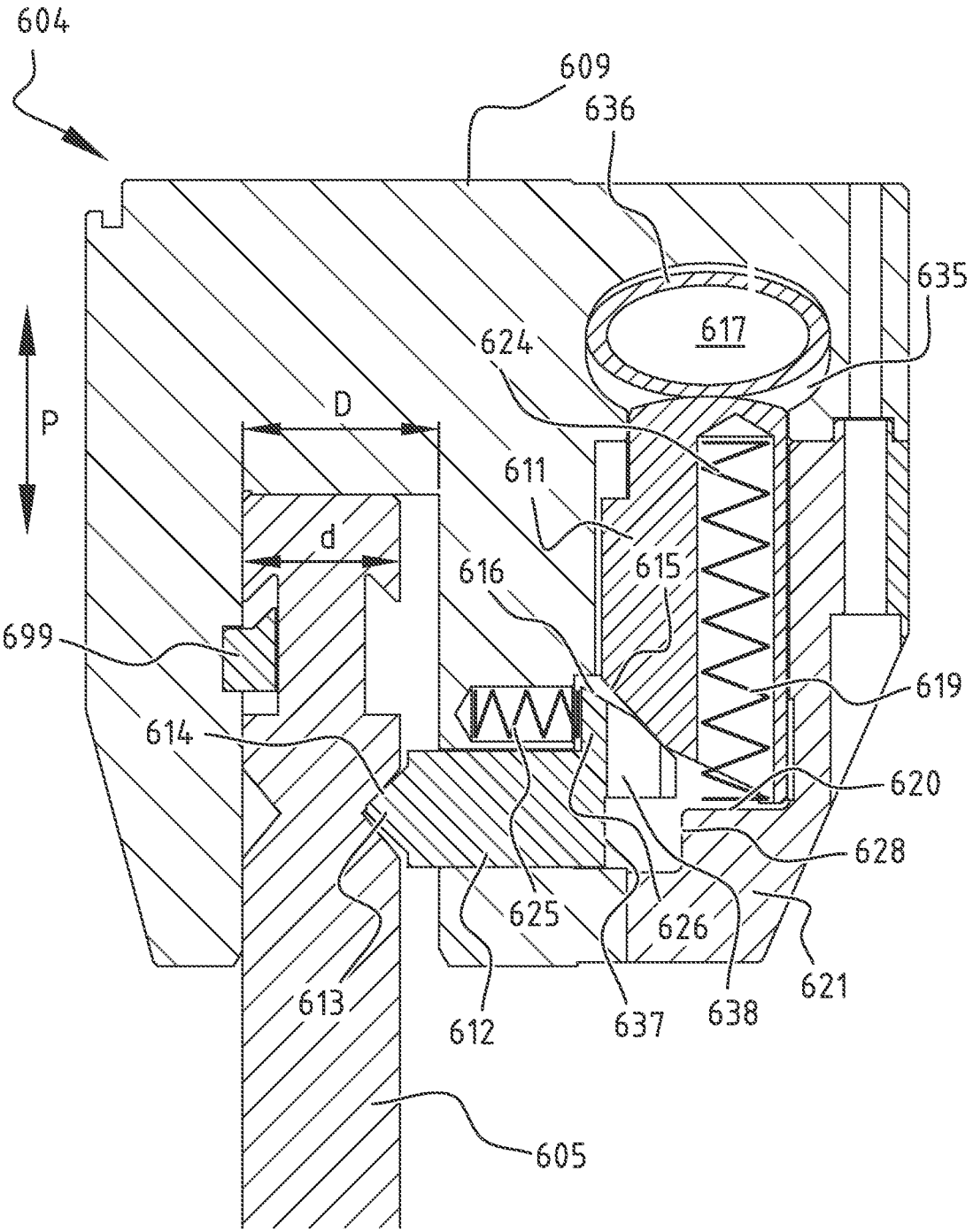
FIG. 8 shows schematically a variation on the clamping system of FIGS. 7A-7C.

FIG. 8 shows a clamping system 604 that differs from the clamping system 504 of FIGS. 7A-7C in that the elongate beam 709 is made of one piece of material. Accordingly, the cavity 635 is formed integrally in that one piece of the elongate beam 609.

Figure 9:
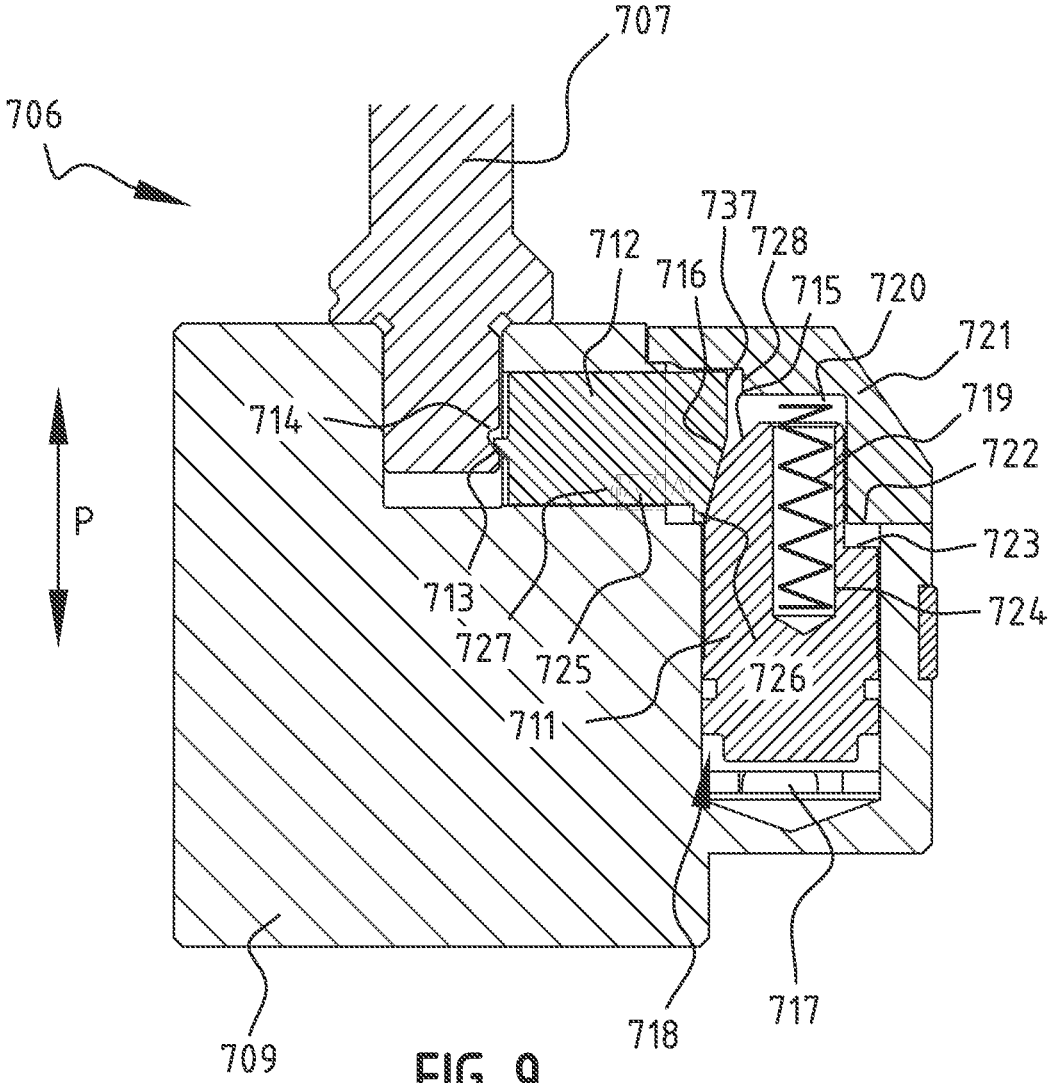
FIG. 9 shows schematically a transversal cross-sectional view of yet another clamping system.

FIG. 9 shows a bottom clamping system 706, that has the features of the clamping system 204 described in relation to FIGS. 2A-3B, apart from a different position of the protrusion 725 of the clamping element 712. The protrusion 726 leaves free an end surface 737 to cooperate with the second stop 728.

Obviously, the bottom clamping system 706 could be altered by applying any of the features described above, such as the separate elongate beam and/or the separate cylinder in the cavity and/or the hose as a pressure chamber.

Figure 10A:
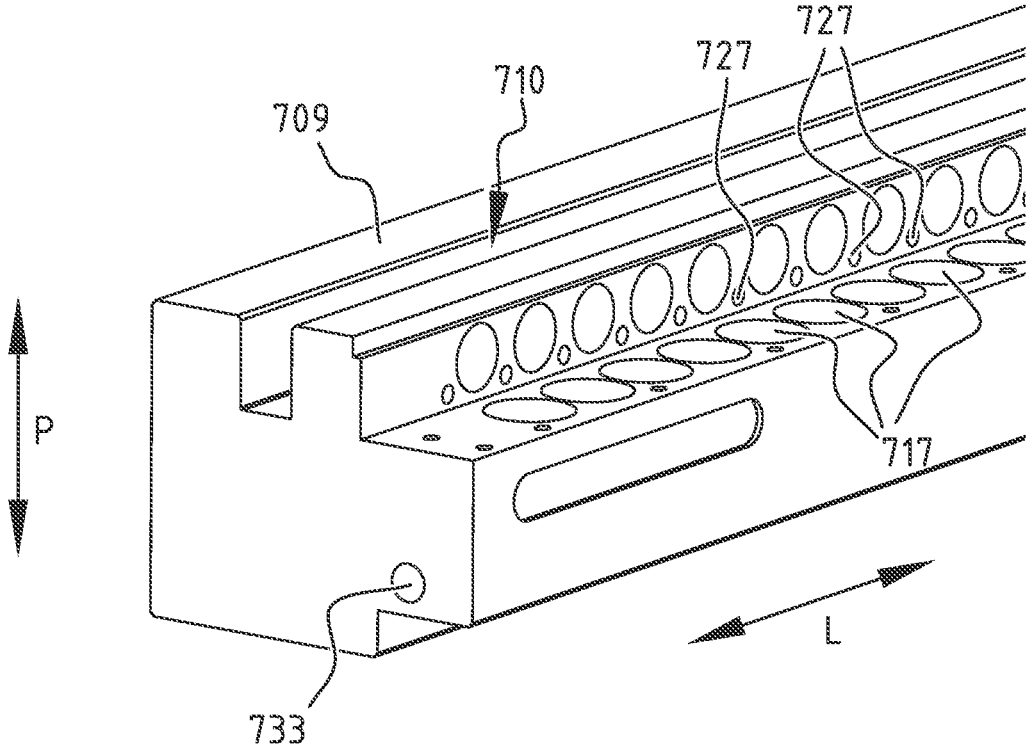
FIGS. 10A and 10B show schematically a perspective view of an elongate beam of the clamping system of FIG. 9 and of a longitudinal cross-sectional thereof.
Figure 10B:
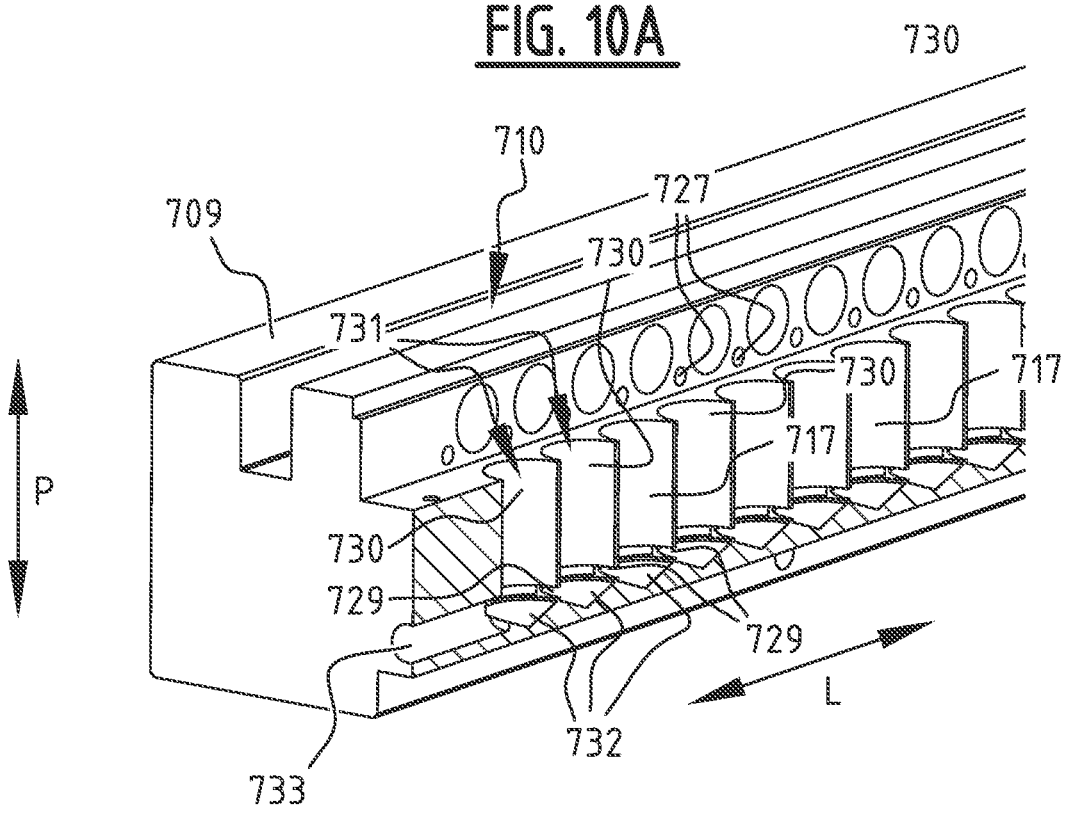

FIGS. 10A and 10B show the elongate beam 709 in more detail. Its features are similar to those described in relation to FIGS. 3A and 3B.

Figure 11A:
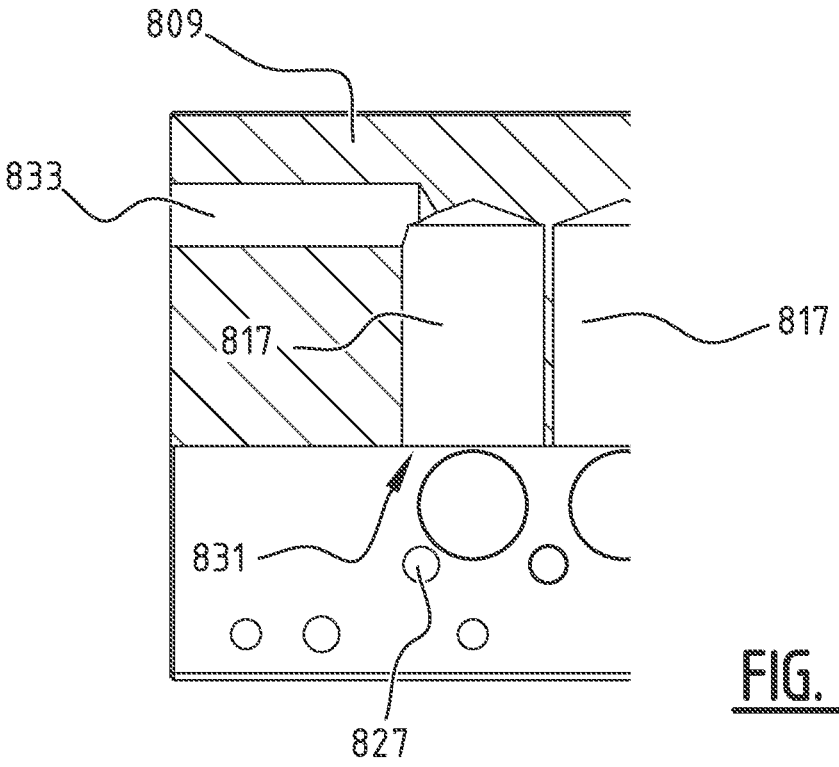
FIGS. 11A-11D show schematically steps in a method of interconnecting cavities in an elongate beam.
Figure 11B:
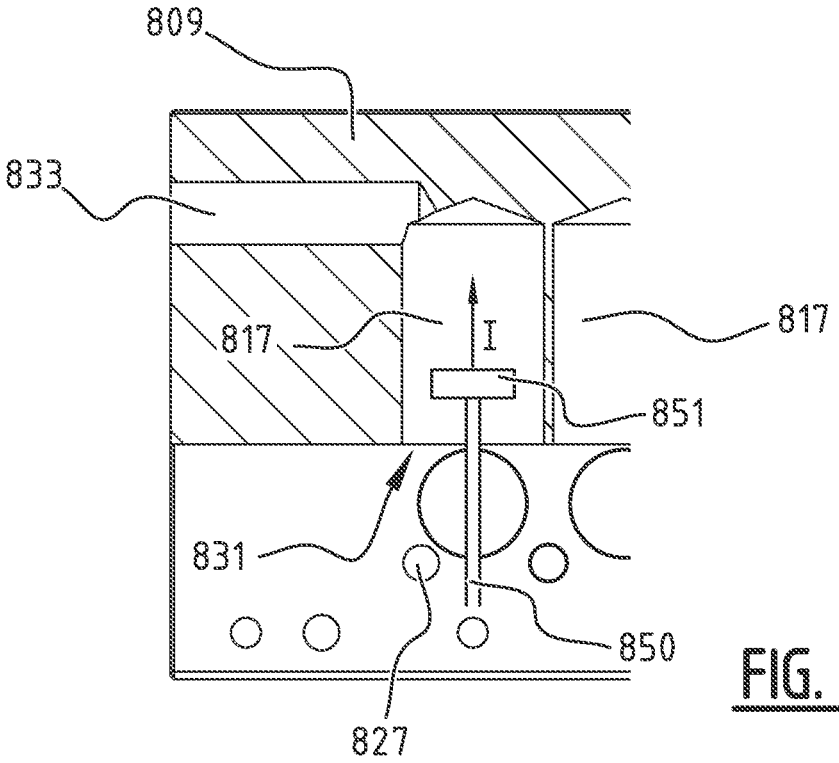
Figure 11C:
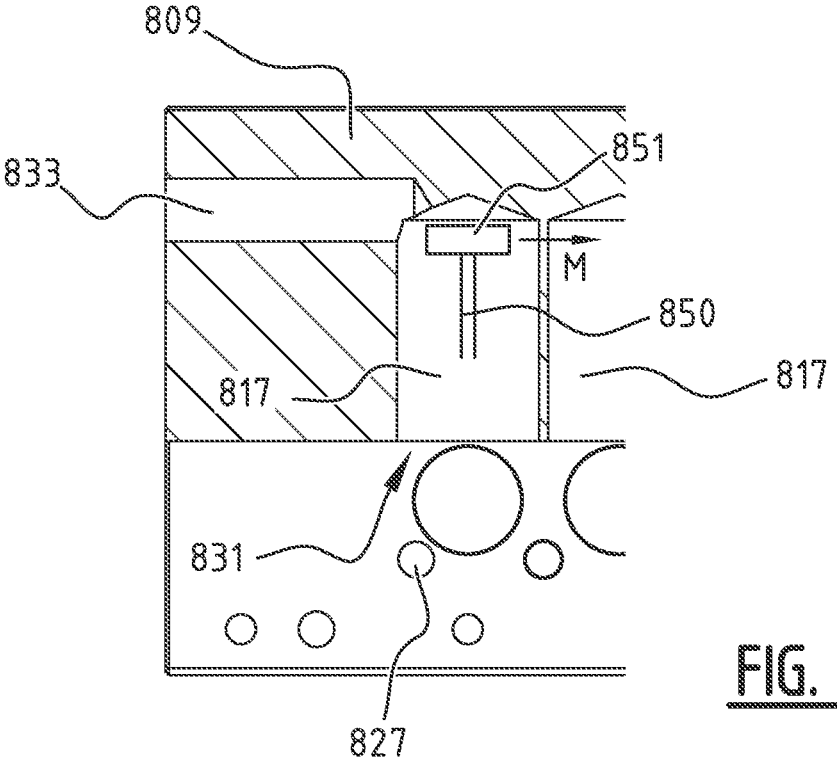
Figure 11D:
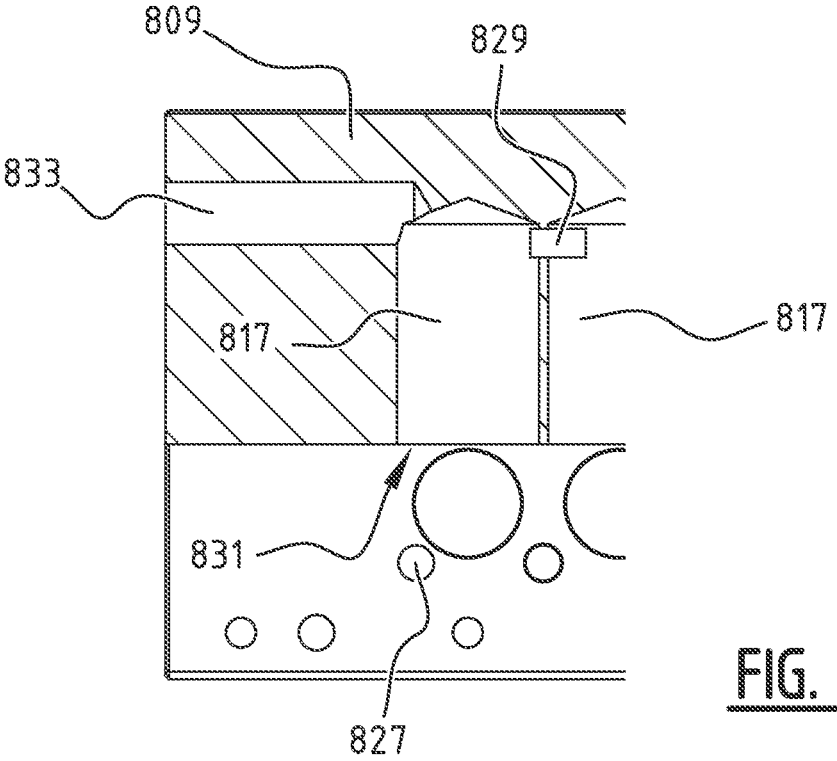

FIGS. 11A-11D show how cavities 817 in an elongate beam 809 can be interconnected internally. First, an elongate beam 809 is provided (see FIG. 11A) with cavities 817 therein. The cavities are not yet interconnected. Then (see FIG. 11B) a milling tool is inserted through the opening 831 of one cavity 817. The milling tool has a narrow stem 850 and a larger head 851. The milling tool is inserted in an insertion direction I. Then (see FIG. 11C) the milling tool is moved in a machining direction M towards another cavity 817, thereby eroding material of the elongate beam 809 and creating a channel 829 between the two cavities. As shown in FIG. 11D, the cavities 817 are thereafter interconnected.

Figure 12:
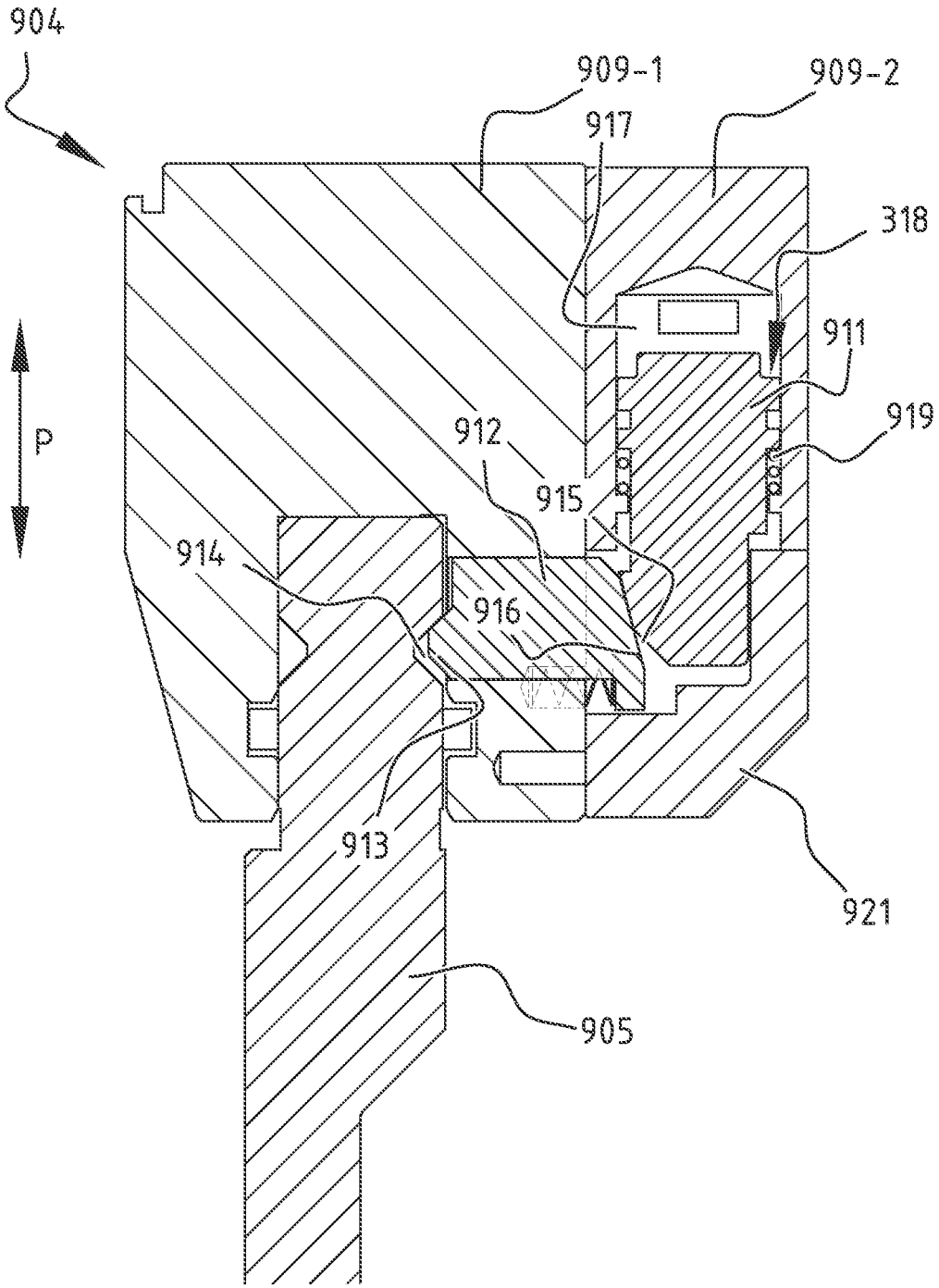
FIG. 12 shows schematically a variation on the clamping system of FIG. 5.

FIG. 12 shows yet another clamping system 904, that differs from the clamping system 304 described in relation to FIG. 5 in that the first compression spring 919 is provided around the actuating member 911 instead of in a cavity therein. No first stop has been shown in FIG. 12. The first compression spring of other clamping systems shown in this application could also be provided around their respective actuating members.

Although the invention has been described hereabove with reference to a number of specific examples and embodiments, the invention is not limited thereto. Instead, the invention also covers the subject matter defined by the claims, which now follow.

The invention claimed is:

1. A clamping system for a press brake, the clamping system comprising:

an elongate beam comprising a receiving space for receiving a part of a bending tool;

a clamping element, the clamping element being movable between a first position, in which it may engage on the bending tool for clamping it in the receiving space, and a second position for releasing the bending tool;

a pressure chamber fillable with a fluid, and an actuating member for driving the clamping element in accordance with a pressure of the fluid in the pressure chamber, wherein the pressure chamber or a cavity housing the pressure chamber is integrally formed in the elongate beam in its entirety.

2. The clamping system according to claim 1, wherein the actuating member is movable within said pressure chamber or the cavity.

3. The clamping system according to claim 1, wherein said cavity or pressure chamber debouches to an exterior of the elongate beam.

4. The clamping system according to claim 3, further comprising a cover for covering at least a debouchment of said cavity or pressure chamber.

5. The clamping system according to claim 1, comprising multiple interconnected pressure chambers or cavities.

6. The clamping system according to claim 1, wherein the pressure chambers or cavities are interconnected internally.

7. The clamping system according to claim 1, further comprising a channel in the elongate beam connected to the pressure chamber or cavity for feeding and/or returning fluid to the pressure chamber or cavity.

8. The clamping system according to claim 1, wherein the pressure chamber is integrally formed with the elongate beam, wherein the actuating member comprises a piston moveable in the pressure chamber.

9. The clamping system according to claim 1, having the cavity formed integrally in the elongate beam, the clamping system further comprising a cylinder housed in said cavity, the cylinder defining the pressure chamber, wherein the actuating member comprises a piston movable in the cylinder.

10. The clamping system according to claim 1, wherein the pressure chamber is defined by a deformable wall arranged in said cavity.

11. The clamping system according to claim 1, wherein the pressure chamber is configured to receive a hydraulic fluid.

12. The clamping system according to claim 1, wherein the pressure chamber is configured to receive a pneumatic fluid.

13. The clamping system according to claim 1, wherein the actuating member is movable between an active position, in which it urges the clamping element towards the first position, and an inactive position in which it allows the clamping element to move to the second position, the clamping system further comprising a first biasing member acting on the actuating member for biasing the actuating member towards its inactive position.

14. The clamping system according to claim 1, the clamping system having a pressing direction, wherein the actuating member is movable in a direction substantially parallel to the pressing direction.

15. The clamping system according to claim 1, wherein at least one of the clamping element and the actuating member is provided with an engagement surface for engaging the other of the clamping element and the actuating member, wherein at least a part of the engagement surface is inclined with respect to a direction of movement of the respective element.

16. A press brake comprising a bottom beam and a top beam, which are movable with respect to each other, configured for holding tools, between which a workpiece can be provided for bending, the press brake further comprising at least one said clamping system according to claim 1 for allowing tools held by the bottom and top beams to be exchanged.

* * * * *